US006044897A

United States Patent [19]

Cross

[11] Patent Number: 6,044,897

[45] Date of Patent: Apr. 4, 2000

[54] METHOD OF PASSIVATING COMMERCIAL GRADES OF ALUMINUM ALLOYS FOR USE IN HOT CHAMBER DIE CASTING

[76] Inventor: Raymond E. Cross, 910 N. Green Bay Rd., Lake Forest, Ill. 60045

[21] Appl. No.: 09/058,083

[22] Filed: Apr. 9, 1998

Related U.S. Application Data

[63] Continuation-in-part of application No. 08/802,872, Feb. 19, 1997, abandoned.

[51] Int. Cl.[7] ..... B22D 27/00

[52] U.S. Cl. ..... 164/473; 164/47; 164/463; 164/55.1; 164/57.1

[58] Field of Search ..... 164/473, 47, 463, 164/55.1, 57.1; 148/415, 416, 417; 420/532, 535, 541, 544, 551, 552

[56] References Cited

U.S. PATENT DOCUMENTS

| | | | |
|---|---|---|---|
| 3,319,702 | 5/1967 | Hartwig et al. . | |
| 3,467,171 | 9/1969 | Fulgenzi et al. . | |
| 3,469,621 | 9/1969 | Fulgenzi . | |
| 3,586,095 | 6/1971 | Fulgenzi . | |
| 3,727,675 | 4/1973 | Bennett . | |
| 4,091,970 | 5/1978 | Komiyama et al. . | |
| 4,231,416 | 11/1980 | Nikolov et al. . | |
| 4,556,098 | 12/1985 | Hintermann et al. | 164/316 |
| 4,808,487 | 2/1989 | Gruenr | 428/610 |
| 4,915,908 | 4/1990 | Nagle et al. | 420/590 |
| 5,180,447 | 1/1993 | Sigworth et al. . | |
| 5,415,708 | 5/1995 | Young et al. . | |
| 5,464,463 | 11/1995 | Miura et al. | 75/244 |
| 5,476,134 | 12/1995 | Whittle et al. . | |
| 5,505,246 | 4/1996 | Colvin et al. | 164/61 |

FOREIGN PATENT DOCUMENTS

| | | |
|---|---|---|
| 553873 | 3/1958 | Canada . |

OTHER PUBLICATIONS

ASM (Specialty Handbook), Al and Al alloys, Davis (ed.) Ohio, 1993, pp. 25–27.

American Society of Metals Committee on Die Casting, "Die Casting," pp. 285–286 (date unknown).

*Primary Examiner*—Patrick Ryan
*Assistant Examiner*—M. Alexandra Elve
*Attorney, Agent, or Firm*—Greer, Burns & Crain, Ltd.

[57] ABSTRACT

A process for increasing the productivity of aluminum castings from a hot chamber die casting machine, as well as a process for increasing the working life of an injection chamber for use in a hot chamber aluminum die casting machine, both of which involve the use of a passivated aluminum alloy in the machine. In the preferred embodiment, the process involves the use of an aluminum alloy which is passivated through the introduction of an amount of $TiBr_2$, provided in amounts sufficient to retard corrosion of the steel of the hot chamber casting machine.

14 Claims, No Drawings

METHOD OF PASSIVATING COMMERCIAL GRADES OF ALUMINUM ALLOYS FOR USE IN HOT CHAMBER DIE CASTING

CROSS-REFERENCES TO RELATED APPLICATIONS

This application is a continuation-in-part of application Ser. No. 08/802,872, filed on Feb. 19, 1997, now abandoned.

BACKGROUND OF THE INVENTION

The present invention relates to the die casting of aluminum alloys, and particularly to aluminum alloys used in hot chamber die casting machines.

Hot chamber type die casting machines include a container for molten metal which is installed adjacent the die casting machine. At least a portion of an injection pump is immersed in the molten metal in the container so that a plunger of the pump may draw the molten metal into the casting machine. For many years, this type of device has been used extensively for casting low melting point metals such as lead, tin and zinc. However, when used for relatively high melting point alloys such as aluminum, hot chamber die casting machines have proved unsatisfactory due to the corrosive effects of the molten alloys, which are very active chemically at high temperatures. In addition to causing deterioration of the high strength steel used to make the casting machine, the corrosion causes contamination of the composition of the cast products.

One conventional solution to this problem has been to use a so-called cold chamber casting machine, in which the molten metal is ladled into an unheated injection cylinder before each filling of the die. The main disadvantages of cold chamber die casting include the fact that when the molten metal is ladled into the casting chamber, a certain amount of oxide is simultaneously transferred as well. Also, it is difficult to determine the exact quantity of molten metal ladled, and further oxidation of the molten metal occurs during the filling of the injection cylinder, which reduces the quality of the molded parts.

For the above reasons, hot chamber casting is preferred because it is relatively faster and provides more uniform results than cold chamber casting, despite the fact that hot chamber casting is more complicated. As such, there have been many attempts over the years to adapt hot chamber casting machines to the corrosive effects of molten aluminum and other relatively high melting point alloys. These attempts typically approached the problem by protecting the metal of the hot chamber machine through ceramic or alloy coatings for portions of the machine coming in contact with the molten aluminum. Such attempts are described in U.S. Pat. Nos. 3,586,095; 4,091,970; 4,556,098; and 5,476,134, all of which are incorporated by reference.

None of these attempts have been particularly successful over the working life of a die casting machine, and as such, until the present invention, there has been little commercialization of hot chamber die casting machines for casting aluminum. As a result, designers of cast or molded parts often select plastic over aluminum due to its castability or moldability in a more efficient manner than cold chamber casting.

Thus, there is a need for a commercially acceptable way to cast aluminum parts using a hot chamber die casting machine. The present invention approaches the problem in a novel way, by passivating the aluminum alloy, or making it noncorrosive to the steel of the die casting machine.

Accordingly, it is a primary object of the present invention to provide a process for improving the productivity of aluminum castings from a hot chamber die casting machine.

Another object of the present invention is to provide a process for increasing the life span of an injection chamber for use in a hot chamber aluminum die casting machine.

BRIEF SUMMARY OF THE INVENTION

The above-identified objects are met or exceeded by the present process, which involves the use of a passivated aluminum alloy which features the ability to be cast in a hot chamber die casting or molding machine or apparatus while enabling the casting apparatus to resist aluminum-induced corrosion or oxidation. Thus, aluminum parts may be manufactured in the same manner as plastic parts, thus making aluminum competitive with injection molded plastic parts.

More specifically, the present invention provides a process for increasing the productivity of aluminum castings from a hot chamber die casting machine, as well as a process for increasing the working life of an injection chamber for use in a hot chamber aluminum die casting machine, both of which involve the use of a passivated aluminum alloy in the machine. In the preferred embodiment, the process involves the use of an aluminum alloy which is passivated through the introduction of a passivating material, such as $TiB_2$, provided in amounts sufficient to retard corrosion of the steel of the hot chamber casting machine. When used with the conventional hot chamber casting machine, the present process, using a passivated alloy, renders the casting apparatus more resistant to corrosion by the aluminum, preferably over the working life of the machine.

DETAILED DESCRIPTION OF THE INVENTION

The passivated or noncorrosive aluminum alloy made and used according to the present invention is suitable for use in hot chamber die casting or molding machinery of the type well known in the art and described in the prior art patents identified above and incorporated by reference herein.

The present process involves the use of a passivated aluminum alloy in a hot chamber type casting machine. A major advantage of this process is that by using a passivated alloy, the casting machine can be used over a longer period of time than conventional hot chamber casting machines when making aluminum parts. This is because the aluminum causes premature corrosion and/or oxidation of the metals making up the casting machine.

It is contemplated that many compounds may be used to passivate aluminum, which itself is available in many different alloys. In the preferred embodiment, the aluminum alloy according to the present invention preferably includes, by weight, approximately 7 to 9% silicon. Silicon is important for increased flowability, and increased ductility. Another preferred component of the present aluminum alloy is by weight, 3 to 4% copper, which is important for holding the grain of the alloy together in order to prevent stress cracks.

Zinc is also preferably present in the alloy at about 3% by weight, iron at about 1.5% to 2.5%, magnesium at about 0.10%, and manganese at about 0.5% to 1.0%. It is believed that the passivating effect of the present alloy is provided by boron, which is present in the approximate range of 2.0 to 5% by weight. In the preferred embodiment, the boron is provided in the form of $TiB_2$ However, it is contemplated that other forms of boron, and other additives may be substituted for the $TiB_2$ and still achieve the desired result of passivating the aluminum.

The balance of the alloy is aluminum, which is preferably 380 Al, a known and conventionally available aluminum alloy. The 380 Al contains by weight approximately 3% zinc, 3 to 4% copper, 7.5 to 9.5% silicon, 1.3% iron, 0.50% manganese, 0.10% magnesium, 0.5% nickel, and 0.35% tin with the balance being aluminum. Other materials such as chromium and/or titanium may be present in trace amounts, however, in the preferred embodiment, the titanium is found in the $TiB_2$. In addition, 380 Al has a density of 0.095 lb/in$^3$ and a melting range of 1000 to 1100° F. It is contemplated that A380 Al may also be employed, depending on the application.

A passivated aluminum alloy according to the present invention can be formulated in the proportions set forth above for use in a hot chamber die casting machine using known techniques. First, the aluminum, preferably 380 Al obtained from pure aluminum or scrap aluminum, is heated in a furnace at 1100–1250° F. to Additional boron-containing aluminum, which typically has an effective amount of $TiB_2$, such as in the range of 5%, and is commercially available, is added to the existing aluminum in a proportion which will result in a percentage of boron in the final alloy being in the range of between 2 to 5%, depending on the application. The combination is then agitated and stirred at high temperatures until mixed. By placing a rod of hardened steel of the type used to manufacture hot chamber die casting machines in a crucible containing the molten mixture, the degree of passivation or noncorrosive properties of the aluminum may be tested. The longer the sample of steel remains free of corrosion, the more effective is the aluminum alloy.

EXAMPLE

The following example is presented to illustrate the superior aspects of a passivated aluminum alloy to assist one of ordinary skill in the art in making and using the present invention with a hot chamber die casting machine, and is not intended in any way to otherwise limit the scope of this disclosure or the protection granted by the Letters Patent hereon.

A passivated aluminum alloy is formulated in a furnace at 1100–1250° F. containing approximately 3–4% copper, 0.10% magnesium, 7–9% silicon, 1.5–2.5% iron, 3% zinc, 2–5% boron ($TiB_2$), 0.5–1.0% manganese and the balance being aluminum.

The alloy is then placed in a container of a hot chamber die casting machine, heated to the molten state, and at least a portion of the pump is immersed in the container to begin the die casting process as the pump draws the molten aluminum alloy from the container and injects the material into the casting chamber of the machine. Alternatively, the aluminum may be heated prior to being placed in the container. A major advantage of the present alloy is that, unlike conventional aluminum die casting alloys in the molten state, the passivation will inhibit corrosion and/or the accumulation of aluminum oxides in the die casting machine, particularly in the "goose neck" or injection chamber portion of the machine, where the molten aluminum is drawn into the die. Parts made by the above process have essentially the same composition as the present alloy.

While a particular embodiment of the process for hot chamber casting of aluminum alloys of the invention has been shown and described, it will be appreciated by those skilled in the art that changes and modifications may be made thereto without departing from the invention in its broader aspects and as set forth in the following claims.

I claim:

1. A process for increasing the productivity of aluminum castings from a hot chamber die casting machine, said process comprising: providing a steel hot chamber die casting machine; providing a supply of molten metal comprising one of aluminum and aluminum alloy; passivating said molten metal by incorporating a metallic boride complex therein; and employing said passivated molten metal in said machine for preventing failure of said machine due to one of corrosion and accumulation of aluminum oxides.

2. The process defined in claim 1, wherein said molten metal is passivated through the introduction of an effective amount of $TiB_2$.

3. The process defined in claim 1, wherein said molten metal is passivated through the introduction of:

Si in an amount of from 7–9% by weight;

Cu in an amount of from 3–4% by weight;

$TiB_2$ in an amount of 2–5% by weight;

Zn in an amount of approximately 3% by weight;

Fe in an amount of from 1.5–2.5% by weight;

Mn in an amount of from 0.5–1.0% by weight; and

Mg in an amount of approximately 0.1% by weight.

4. A process for increasing the working life of an injection chamber of a hot chamber aluminum die casting machine, said process comprising providing a supply of molten metal comprising one of aluminum and aluminum alloy; passivating said molten metal by incorporating a metallic boride complex therein; and passing said passivated molten metal through said injection chamber for preventing failure of said injection chamber due to one of corrosion and accumulation of aluminum oxides.

5. The process defined in claim 4, wherein said molten metal is passivated through the introduction of an effective amount of $TiB_2$.

6. The process defined in claim 4, wherein said molten metal is passivated through the introduction of:

Si in an amount of from 7–9% by weight;

Cu in an amount of from 3–4% by weight;

$TiB_2$ in an amount of 2–5% by weight;

Zn in an amount of approximately 3% by weight;

Fe in an amount of from 1.5–2.5% by weight;

Mn in an amount of from 0.5–1.0% by weight; and

Mg in an amount of approximately 0.1% by weight.

7. A process for hot chamber casting of aluminum, including:

providing a steel hot chamber casting machine;

providing an aluminum alloy comprised of aluminum, silicon, iron, copper and a metallic boride complex;

heating said alloy until it is molten; and placing said alloy in close association with the machine so that it may be drawn into the machine to cast pars without causing corrosion thereof.

8. The process defined in claim 1 wherein said molten metal comprises aluminum and silicon.

9. The process defined in claims wherein said molten metal further comprises approximately 7.0–9.0% silicon by weight.

10. The process defined in claim 1 wherein said molten metal comprises aluminum, silicon and boron.

11. The process defined in claim 4 wherein said molten metal comprises aluminum and silicon.

12. The process defined in claim 11 wherein said molten metal further comprises 7.0–9.0% silicon.

13. The process defined in claim 4 wherein said aluminum alloy comprises aluminum, silicon and boron.

14. The process defined in claim 1 wherein said hot chamber die casting machine is free of ceramic or alloy coatings.

* * * * *

UNITED STATES PATENT AND TRADEMARK OFFICE

CERTIFICATE OF CORRECTION

PATENT NO. : 6,044,897
DATED : April 4, 2000
INVENTOR(S) : Cross

It is certified that error appears in the above-indentified patent and that said Letters Patent is hereby corrected as shown below:

In the Claims:

In claim 2, line 2, delete "crash" and insert

--crush-- therefor

In claim 2, line 4, delete "fibs" and insert

--ribs-- therefor

In claim 14, line 2, delete "crash" and insert

--crush-- therefor

In claim 33, line 30, delete "definig" and insert

--defining-- therefor

Signed and Sealed this

Tenth Day of April, 2001

Nicholas P. Godici

*Attest:*

NICHOLAS P. GODICI

*Attesting Officer*

*Acting Director of the United States Patent and Trademark Office*

UNITED STATES PATENT AND TRADEMARK OFFICE

CERTIFICATE OF CORRECTION

PATENT NO. : 6,044,897
DATED : April 4, 2000
INVENTOR(S) : Raymond E. Cross

It is certified that error appears in the above-identified patent and that said Letters Patent is hereby corrected as shown below:

Column 4,
Line 47, delete "pars" and insert --parts-- therefor (As in claim 7, line 7).
Line 51, delete "claims" and insert --claim 8-- therefor (As in claim 9, and as requested in Amendment A, on page 5, line 1).

Signed and Sealed this

Third Day of July, 2001

*Attest:*

Nicholas P. Godici

*Attesting Officer*

NICHOLAS P. GODICI
*Acting Director of the United States Patent and Trademark Office*

UNITED STATES PATENT AND TRADEMARK OFFICE

CERTIFICATE OF CORRECTION

PATENT NO. : 6,044,897
DATED : April 4, 2000
INVENTOR(S) : Raymond E. Cross

It is certified that error appears in the above-identified patent and that said Letters Patent is hereby corrected as shown below:

This certificate supercedes certificate of correction issued April 10, 2001, the number was erroneously mentioned and should be deleted since no certificate of correction was granted.

Signed and Sealed this

Thirteenth Day of November, 2001

*Attest:*

Nicholas P. Godici

NICHOLAS P. GODICI
*Acting Director of the United States Patent and Trademark Office*

*Attesting Officer*